United States Patent [19]

Cason

[11] Patent Number: 5,044,995

[45] Date of Patent: Sep. 3, 1991

[54] BATTERY TERMINAL CABLE CONNECTOR

[75] Inventor: Richard W. Cason, Coolidge, Ariz.

[73] Assignee: R. D. Walker, Casa Grande, Ariz.

[21] Appl. No.: 572,702

[22] Filed: Aug. 27, 1990

[51] Int. Cl.[5] ..... H01R 13/00

[52] U.S. Cl. ..... 439/757

[58] Field of Search ..... 439/152, 153, 155, 159, 439/160, 754, 757, 758

[56] References Cited

U.S. PATENT DOCUMENTS

| | | | |
|---|---|---|---|
| 2,706,284 | 2/1954 | Hoggatt et al. | 339/238 |
| 2,737,636 | 3/1956 | Valentine et al. | 439/757 |
| 3,307,140 | 2/1967 | Vallinotto et al. | 439/757 |
| 3,340,498 | 9/1967 | Meyer | 339/238 |
| 3,678,450 | 7/1972 | Azamber et al. | 439/757 |
| 3,764,961 | 10/1973 | Poltras | 339/224 |
| 3,988,051 | 10/1076 | Robinson | 339/238 |
| 4,555,159 | 11/1985 | Chartain | 339/239 |

FOREIGN PATENT DOCUMENTS

| | | |
|---|---|---|
| 2417856 | 10/1979 | France . |
| 572866 | 9/1977 | U.S.S.R. . |
| 1115324 | 5/1968 | United Kingdom . |

*Primary Examiner*—Joseph H. McGlynn

*Attorney, Agent, or Firm*—Warren F. B. Lindsley

[57] ABSTRACT

A solid rectangular clamp having a aperture extending laterally therethrough for receiving a battery post and a U-shaped member the legs of which are pivotally mounted within indentations in the sides of said clamp one on each side thereof. A bolt is threadedly mounted to extend through the bight of the U-shaped member and through a further aperture in one end of the clamp until it engages and holds the battery post in the clamp. When withdrawn the bolt releases the battery post and when the U-shaped member is pivotally movable over the aperture which receives the battery post and is turned to penetrate this aperture to engage the battery post, it forces the clamp off of the battery post.

5 Claims, 1 Drawing Sheet

FIG. 1
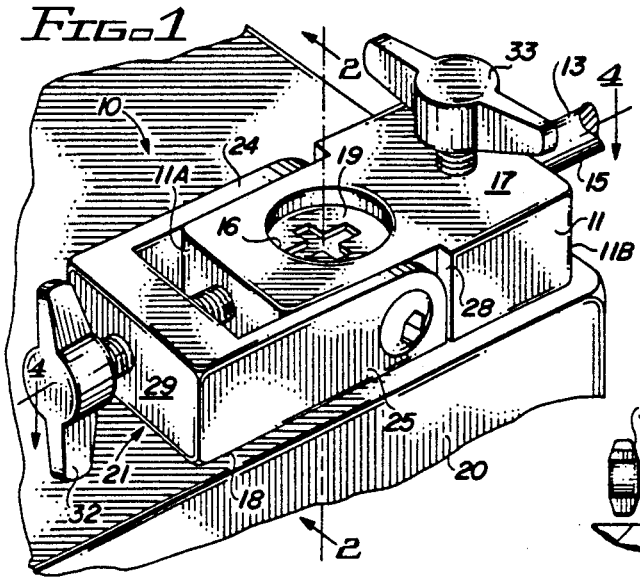
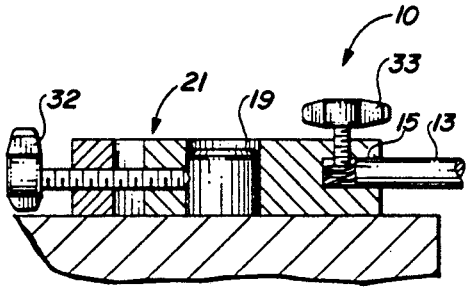
FIG. 2
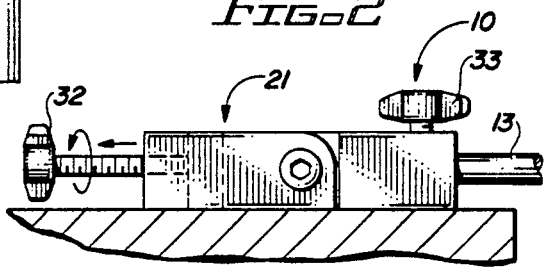
FIG. 3A
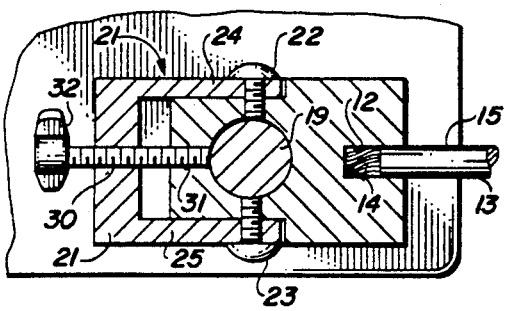
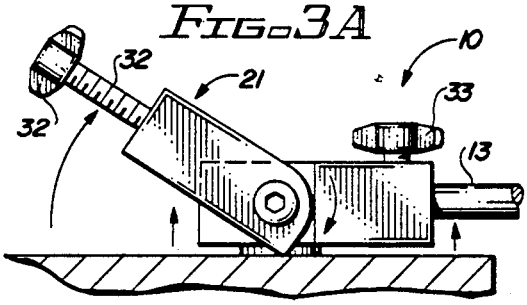
FIG. 4
FIG. 3B
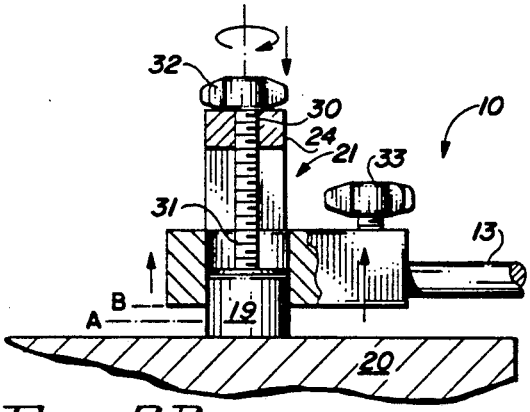
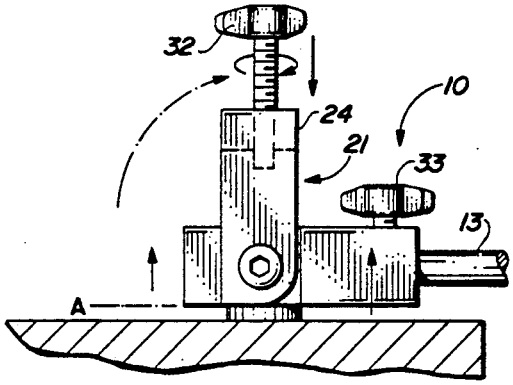
FIG. 3D
FIG. 3C

BATTERY TERMINAL CABLE CONNECTOR

BACKGROUND OF THE INVENTION

This invention relates to electrical connectors and more particularly to battery terminal connector means for attaching a cable or the like to a post or terminal of a storage battery.

Pior art connectors employ U-shaped heads squeezed together by bolt and nut assemblies for clamping onto the terminals or connectors. This type of connector requires the application of considerable force to effect the connection and unless sufficient force is applied, the connector may rattle loose or become loosened under other accidental forces being applied thereto.

Further, in the removal of the connector from the terminal some kind of pulling tool is used which puts a strain on the battery post usually with considerable damage to the battery.

The present invention provides a manually attachable and removable connector that requires no significant force or special tool to effect fastening or removal of the clamp from the battery terminal.

Description of the Prior Art

U.S. Pat. No. 2,706,284 discloses a quick release battery terminal split for surrounding the battery post and held in intimate contact therewith through a lever arrangement, by means of which lever arrangement the clamp also may be quickly released and pulled from contact with the battery post.

U.S. Pat. No. 3,340,498 discloses a connector for use in connecting conductors to cylindrical terminals and includes a resiliant lever having an end portion moveable in an annular terminal receiving portion from an open end position to a clamping position in which latter position the lever is held by detent means.

U.S. Pat. No. 3,764,961 discloses a storage battery terminal post connector comprising a pair of levers which are pivoted together at their one ends so that the opposite ends of the levers, which form jaws, can be brought together on opposite sides of the battery terminal posts. A compression coil spring normally urges the levers so that the jaws thereof firmly grasp the battery terminal post.

U.S. Pat. No. 3,988,051 discloses a clamping means for clasping terminal battery posts comprising the known lever-wrench pliers having an electrical conductor mechanically and conductively coupled to the fixed head of one of the handles of the pliers. The heads of the working handles of the pliers are adapted to envelop and compressively clasp a terminal post of a storage battery.

U.S. Pat. No. 4,555,159 discloses a quick-release battery post connector having an electrically conductive U-shaped clamp with legs that are connected by a pivot member which reciprocates in response to movement of a lever about an upstanding post on each leg. The lever has a boss that rotates within an opening in the pivot members and includes apertures into which extends one of the clamp leg posts. The aperture axis is offset from the rotational axis of the boss whereby movement of the lever will result in changing the distance between the spaced-apart legs.

British Patent No. 1,115,324 discloses a battery terminal cable comprising a cylindrical body portion having a frusto-conical recess thereon adapted to seat snugly on a tapered battery terminal post.

French Patent No. 2,417,856 discloses a cable connector for a battery terminal comprising a U-shaped post having a hole in each side of the U-configuration corresponding to the size of the battery terminal one being slightly larger than the other and a metal strip bent into a circle and having a folded triangular extension which is fitted within the holes of the U-shaped post. The cable is trapped by the two parts at the base of the U-shaped configuration.

The U.S.S.R. Patent No. 572866 discloses a battery clamp employing a pair of jaws that revolve in relation to one another so that the jaws rest on the terminal and on moving a lever the teeth of the jaws may be made to cut into the terminals.

Summary of the Invention

In accordance with the invention claimed, a new and improved battery terminal clamp is provided which is readily mounted on and removed from a battery terminal post.

It is, therefore, one object of this invention to provide a new and improved battery terminal clamp that does not need any tools for securement or removal from a battery terminal post.

Another object of this invention is to provide a new and improved battery terminal clamp that employs a dual purpose U-shaped arm that firmly clamps the clamp to the battery terminal in one position and aids in removing the clamp from the terminal in another position.

A further object of this invention is to provide an improved battery terminal clamp employing a finger actuated bolt that fastens the clamp to the battery post in one position along its length and forces the clamp from the battery post when pivotally moved to another position.

Further objects and advantages of the invention will become apparent as the following description proceeds and the features of novelty which characterize this invention will be pointed out with particularity in the claims annexed to and forming part of this specification.

Brief Description of the Drawing

The present invention may be more readily described by reference to the accompanying drawing, in which:

FIG. 1 is a perspective view of a battery terminal clamp mounted on the battery post of a vehicle battery;

FIG. 2 is a cross sectional view of FIG. 1 taken along the line 2—2;

FIG. 3A is a side view of FIG. 1 showing the pivotal movable U-shaped arm in its horizontal clamping position;

FIG. 3B is a view similar to FIG. 3A with the U-shaped arm pivotally movable toward a vertical upright position;

FIG. 3C is a view similar to FIGS. 3A and 3B showing the U-shaped arm in its upright substantially vertical position;

FIG. 3D is a view similar to FIGS. 3A, 3B and 3C showing the bolt of the U-shaped arm extended to engage the battery post for removing of the clamp from the battery post upon further threaded movement of the bolt toward the battery post; and FIG. 4 is a cross sectional view of FIG. 1 taken along the line 4—4.

Description of the Preferred Embodiment

Referring more particularly to the drawing by characters of reference, FIGS. 1–4 disclose a battery clamp 10 comprising a solid conductive rectangular member 11 having an aperture 12 formed in one end thereof for receiving a battery cable 13 the end 14 of which is stripped of its insulating covering 15 so that the metal ends of the cable are in conductive relationship with member 11 inside of aperture 12. Aperture 12 may be large enough to receive more than one cable or wire and still fall within the scope of this invention.

Member 11 is provided with a further aperture 16 extending laterally through its top and bottom surfaces 17 and 18 for snuggly receiving a post 19 of a battery 20 as shown in FIG. 1.

Pivotally attached to member 11 at the end 11A of member 12 opposite from end 11B in which aperture 12 is formed therein is a U-shaped member 21. This member is provided with pins 22 and 23 extending laterally inwardly of its legs 24 and 25 which pins are journalled in suitable bearings in legs 24 and 25, as shown in FIG. 4.

This U-shaped member is fitted into a cut away portion, indentation or groove of member 11 and having the same height as member 12 forms with member 11 a rectangular block configuration as shown in FIG. 1.

The bight 29 of U-shaped member 21 is provided with a threaded aperture 30 which is in axial alignment in its horizontal position with a threaded aperture 31 extending through member 11 and into aperture 16 as shown in FIG. 4.

Thus, if a threaded bolt 32 is caused to penetrate through apertures 30 and 31 into contact with post 19 of battery 20, clamp 10 may be securely fastened thereto. If bolt 32 is threadedly withdrawn from aperture 31, the U-shaped member 21 may be pivotally movable from the position shown in FIG. 3A through the sequence of steps shown in FIGS. 3B and 3C.

When in the position shown in FIG. 3C, bolt 32 may be rotated clockwise causing the battery clamp 10 to be forced off of battery post 19 in a known manner.

It should be noted that the U-shaped member 21 provides a dual function, namely in one position to hand fasten clamp 10 to battery post 19, as shown in FIG. 4, and in a second position to remove it from the post, as shown in FIG. 3D, by use of a common threaded wing bolt arrangement.

FIG. 2 also illustrates that cable 13 may be firmly held in aperture 12 by a wing nut and bolt assembly 33.

Although but one embodiment of the present invention has been illustrated and described, it will be apparent to those skilled in the art that various changes and modifications may be made therein without departing from the spirit of the invention or from the scope of the appended claims.

What is claimed is:

1. A connector for clasping to a terminal post of a storage battery comprising:

an elongated clamp having a first aperture extending laterally therethrough for receiving a battery post, a U-shaped member comprising a pair of spaced legs interconnected at one end by a bight and pivotally mounted to the sides of said clamp in one position and movable to a second position extending laterally of said clamp and over said first aperture, a second threaded aperture extending laterally through said bight, a third threaded aperture extending into said one end of said clamp and into said first aperture, a first bolt threadedly mounted in said second aperture in said bight and selectively threadable to penetrate into said third aperture and into contact with a battery post when inserted into said first aperture, said first bolt when threadedly withdrawn from said second aperture permitting said U-shaped member to be pivotally moved to said position laterally of said clamp with said second aperture being axially aligned with said first aperture, said first bolt when threadedly moved through said second aperture and into said first aperture engaging the battery post therein and forcing said clamp off of the battery post upon further rotation of said first bolt, a fourth threaded aperture in said other end of said clamp for receiving a conductor, and a second winged bolt for threadedly extending in said fourth aperture for holding said conductor in said fourth aperture.

2. The connector set forth in claim 1 wherein:

said clamp is formed of a solid conductive material.

3. The connector set forth in claim 1 wherein:

said clamp and U-shaped member are formed of solid conductive material.

4. The connector set forth in claim 1 wherein:

said clamp is indented on each side thereof, and the legs of said U-shaped member are pivotally mounted one in each of said indentations, thereby forming with said clamp a rectangular configuration.

5. The connector set forth in claim 4 wherein:

said rectangular configuration has planar upper and lower surfaces.

* * * * *